US010407916B1

(12) United States Patent
Samad

(10) Patent No.: US 10,407,916 B1
(45) Date of Patent: Sep. 10, 2019

(54) PORTABLE ADJUSTABLE STAIR RAILING

(71) Applicant: Amer Samad, Williamsville, NY (US)

(72) Inventor: Amer Samad, Williamsville, NY (US)

( * ) Notice: Subject to any disclaimer, the term of this patent is extended or adjusted under 35 U.S.C. 154(b) by 449 days.

(21) Appl. No.: 14/732,076

(22) Filed: Jun. 5, 2015

(51) Int. Cl.
*E04F 11/18* (2006.01)

(52) U.S. Cl.
CPC ..... *E04F 11/1865* (2013.01); *E04F 11/1817* (2013.01); *E04F 2011/187* (2013.01); *Y10T 403/32483* (2015.01)

(58) Field of Classification Search
CPC ..... E04F 11/06; E04F 11/068; E04F 11/18; E04F 11/1812; E04F 11/1817; E04F 11/1834; E04F 11/1846; E04F 11/1861; E04F 11/1865; E04F 2011/1868; E04F 2011/187; E04G 5/142; E04G 25/04; Y10T 403/32483
USPC ..... 256/65.04, 65.05, 65.14, 67; 403/109.3
See application file for complete search history.

(56) References Cited

U.S. PATENT DOCUMENTS

| | | | | | |
|---|---|---|---|---|---|
| 699,509 | A | | 5/1902 | Finnegan | |
| 2,834,621 | A | | 5/1958 | Schroer | |
| 2,873,904 | A | | 2/1959 | McCormick | |
| 3,421,529 | A | | 1/1969 | Vestal | |
| 3,589,682 | A | * | 6/1971 | Dickey | E04G 25/06 256/59 |
| 3,757,894 | A | | 9/1973 | Chamberlin | |
| 3,813,703 | A | * | 6/1974 | Beaudin, Jr. | E04H 4/065 4/487 |
| 3,823,857 | A | * | 7/1974 | Yandt | B62D 43/02 224/42.12 |
| 3,947,140 | A | * | 3/1976 | Thomas | A61H 3/02 403/379.5 |
| 3,995,832 | A | * | 12/1976 | Wiese | E04H 3/123 182/106 |
| 4,030,255 | A | | 6/1977 | Hartman | |
| 4,034,829 | A | * | 7/1977 | Hoffman | E06C 1/24 182/106 |
| 4,234,112 | A | * | 11/1980 | Gallant | B60R 9/12 211/70.5 |
| 4,385,849 | A | * | 5/1983 | Crain | F16B 7/105 343/901 |
| 4,565,409 | A | * | 1/1986 | Hollonbeck | A47C 16/00 297/411.1 |
| 4,616,668 | A | * | 10/1986 | Battiston | A45B 9/00 135/75 |

(Continued)

FOREIGN PATENT DOCUMENTS

| | | | | |
|---|---|---|---|---|
| DE | 102013000936 A1 | * | 9/2013 | E04G 21/3228 |
| JP | 2992881 B2 | * | 12/1999 | E04G 5/142 |
| JP | 2003105966 A | * | 4/2003 | E04G 5/142 |

*Primary Examiner* — Josh Skroupa
(74) *Attorney, Agent, or Firm* — Vincent G. LoTempio; Kloss, Stenger & LoTempio; David Stephenson

(57) ABSTRACT

A portable adjustable stair railing includes a plurality of telescopically adjustable balusters having structural attachments at the bottom of each, such as, for example, adhesives, suction cups, or removable fasteners, such as bolts. The height adjustment for each baluster is set by spring-biased buttons and cooperating apertures located on the two sleeved portions of the baluster. The top balustrade receiving end of each of the balusters includes a collar-like receiver and a set screw to hold the balustrade in the desired position. This balustrade collar further includes a pitch or angle adjustment for allowing pitch lines, or runs, on various staircases.

19 Claims, 12 Drawing Sheets

(56) References Cited

U.S. PATENT DOCUMENTS 4,645,183 A * 2/1987 Rattray ..... A47D 13/063 256/25
4,664,227 A * 5/1987 Hansen ..... E04F 11/18 182/106
4,772,068 A * 9/1988 Gleckler ..... A47C 7/002 248/188.5
5,087,005 A * 2/1992 Holoff ..... A47G 23/0225 248/205.8
5,139,040 A * 8/1992 Kelly ..... A61H 3/02 135/69
5,188,342 A * 2/1993 Ouellette ..... E01F 13/02 256/1
5,369,921 A 12/1994 Glenn
5,456,451 A 10/1995 Eyler, Jr.
5,551,194 A * 9/1996 Toomey ..... E04F 11/1863 256/65.16
5,842,685 A * 12/1998 Purvis ..... E04G 21/3223 182/113
5,957,146 A 9/1999 Corey
6,279,880 B1 * 8/2001 Hawks, Jr. ..... E04G 21/3223 256/65.03
6,386,519 B1 * 5/2002 Priefert ..... E01F 13/022 256/1
6,406,002 B1 * 6/2002 Hardy, III ..... E01F 13/022 256/23
6,409,412 B1 * 6/2002 Huang ..... F16B 2/246 248/188.5
6,966,530 B2 * 11/2005 Hsu ..... F16B 47/00 248/205.5
7,063,186 B1 * 6/2006 Granke ..... E04G 21/3223 182/106
7,614,612 B2 * 11/2009 Edwards ..... E04F 11/1834 256/67
8,474,575 B2 * 7/2013 Bissett ..... E04G 5/04 182/113
8,608,580 B2 * 12/2013 Khanna ..... A63G 21/00 297/217.1
2002/0104987 A1 * 8/2002 Purvis ..... E04G 21/3223 256/65.14
2013/0236237 A1 * 9/2013 Schmidt ..... F16B 7/042 403/109.3
2014/0199112 A1 * 7/2014 Milner ..... E04F 11/1834 403/72

* cited by examiner

PORTABLE ADJUSTABLE STAIR RAILING

BACKGROUND OF THE INVENTION

Field of the Invention

The present invention relates generally to railings and, more specifically, to a portable adjustable stair railing having a plurality of selectively positionable telescopic balusters having a bottom end incorporating baluster attachment means and a top end incorporating balustrade receptacle incorporating a pitch adjustment for the cooperating balustrade which is also telescopic.

Description of the Prior Art

There are other railings and supports which provide for adjustability and portability for installation in various environments. While these railings may be suitable for the purposes for which they where designed, they would not be as suitable for the purposes of the present invention as heretofore described.

It is thus desirable to provide a stair railing having a plurality of telescopic balusters incorporating a spring latch for selectively adjusting the height of the baluster. It is further desirable to provide a telescopic rail/balustrade that may be secured to the adjustable rail collar located on the upper end of the baluster.

SUMMARY OF THE PRESENT INVENTION

A primary object of the present invention is to provide a portable adjustable stair railing that can be structurally mounted and dismounted from stairs as needed.

Another object of the present invention is to provide a portable adjustable stair railing that easily mounts to stairs without a railing to aid the recently injured or handicapped in ascending and descending the stairs.

Yet another object of the present invention is to provide a baluster having a pair of slidably engageable rods with one having a plurality of spaced apart apertures and the other having a spring-tensioned button that can be selectively positioned within one of said spaced apart apertures thereby adjusting the desired height of the baluster.

Still yet another object of the present invention is to provide a baluster having a bottom end with releasable fastening means for securing the fastening means to a structure such a stair.

Another object of the present invention is to provide a baluster wherein the fastening means is selected from the group of adhesive pad, suction cup and flanged fastener.

Yet another object of the present invention is to provide a baluster having a baluster cap and a balustrade receptacle with a pivot joint therebetween to adjust the receiving angle for the balustrade.

Still yet another object of the present invention is to provide a telescopic balustrade which is both positionable and latchable within the respective balustrade receptacle collars.

Additional objects of the present invention will appear as the description proceeds.

The present invention overcomes the shortcomings of the prior art by providing a portable adjustable stair railing having a plurality of selectively positionable telescopic balusters having a bottom end incorporating a baluster attachment means and a top end incorporating balustrade receptacle which includes pitch adjustment means for the balustrade, which additionally is telescopic to extend between the positioned balusters.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now descriptively to the drawings, in which similar reference characters denote similar elements throughout the several views, the Figures illustrate the medical apparatus of the present invention. With regard to the reference numerals used, the following numbering is used throughout the various drawing figures.

10 portable adjustable stir railing
12 telescopic baluster
14 telescopic baluster bottom portion
16 telescopic baluster top portion
18 baluster bottom portion structure attachment end
20 baluster top portion balustrade receiving end
22 baluster top portion biased engagement means
24 baluster bottom portion biased engagement means receiving apertures
28 telescopic balustrade
30 stair step
32 stair riser
34 flanged adhesive base
36 suction cup
38, 40 cooperating threaded attachments
42 removable fasteners
44 removable fastener receiving apertures
46, 48 pivot receivers
50 balustrade pivot extender
52 pivoting balustrade collar/receiver
54 balustrade set screw
56 pivot nut
58 pivot bolt
60 first telescopic balustrade section
62 second telescopic balustrade section
64 pivot apertures
66 biased engagement means spring
U user
A1 telescopic baluster directional arrow
A2 telescopic balustrade directional arrow

BRIEF DESCRIPTION OF THE DRAWING FIGURES

In order that the invention may be more fully understood, it will now be described, by way of example, with reference to the accompanying drawing in which:

FIG. 1 is an illustrative view of the portable adjustable stair railing.

FIG. 2, comprised of FIGS. 2A and 2B in combination, is an illustrative view of the portable adjustable stair rail adhesively attached.

FIG. 3, comprised of FIGS. 3A and 3B in combination, is an illustrative view of the portable adjustable stair rail with exploded suction cup.

FIG. 4, comprised of FIGS. 4A and 4B in combination, is an illustrative view of the portable adjustable stair rail with attached suction cup.

Figures 10A, 10B:
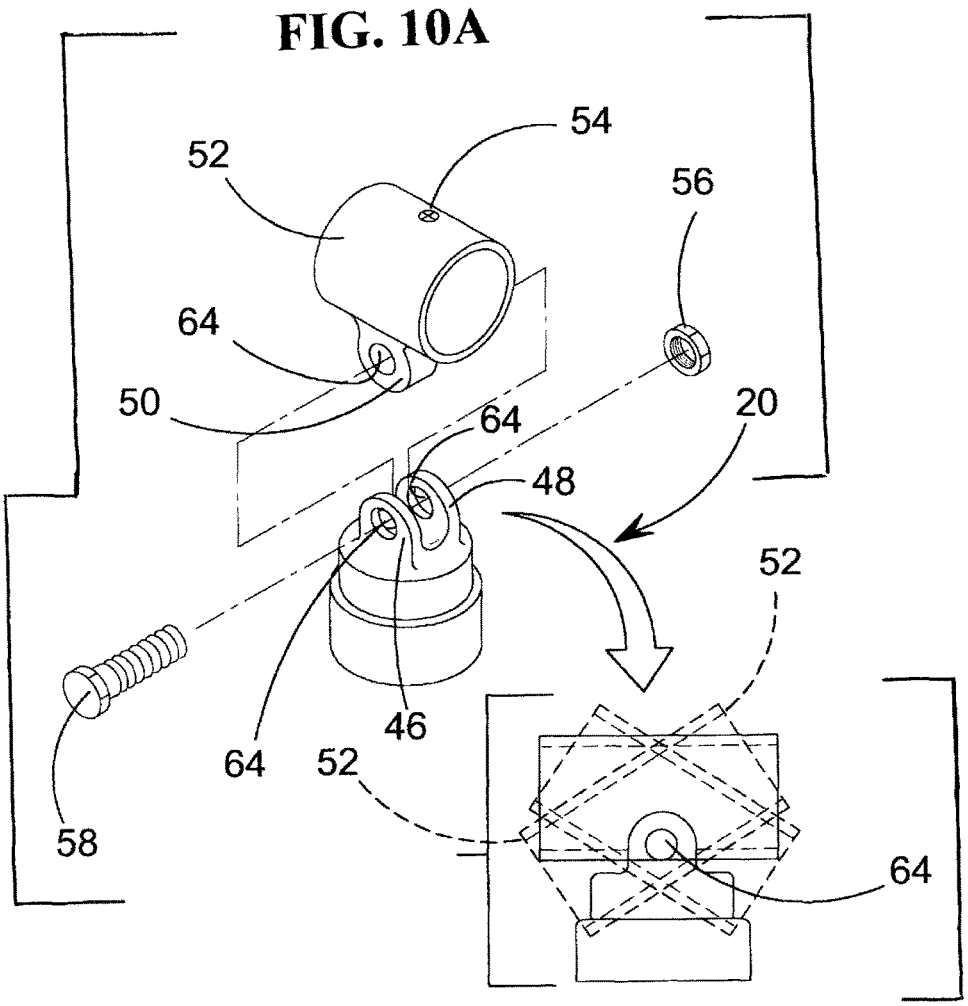

FIG. 10, comprised of FIGS. 10A and 10B in combination, is an exploded detail view of the present invention.

Figures 11A, 11B:
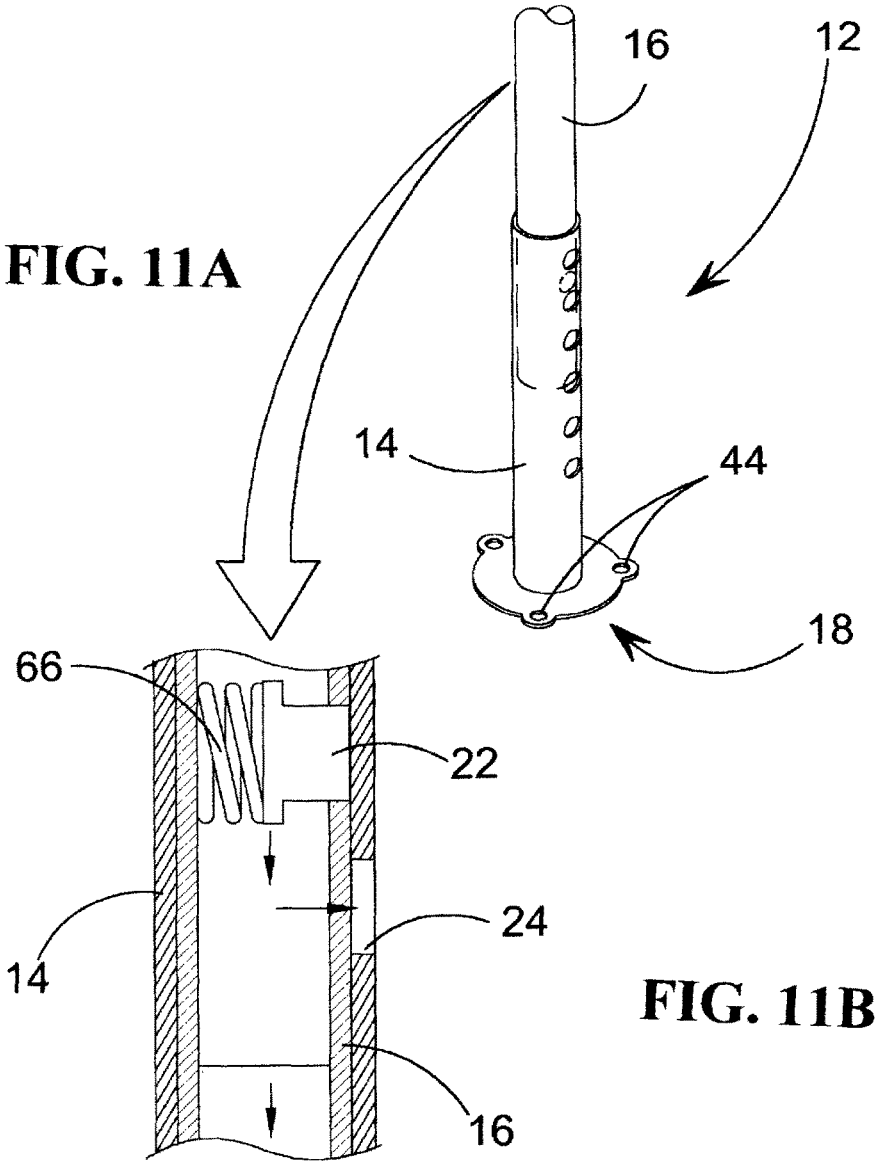

FIG. 11, comprised of FIGS. 11A and 11B in combination, is a detailed view of the present invention.

Figure 12A:
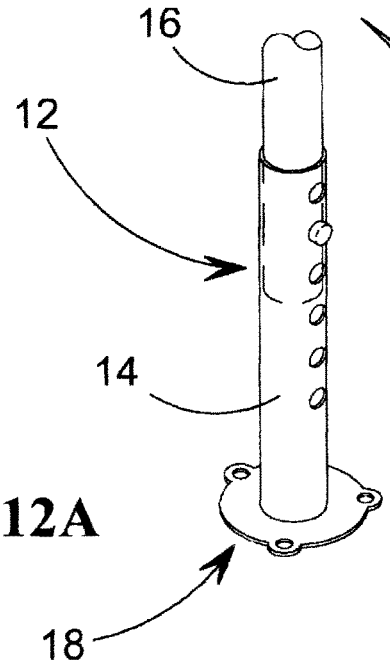
Figure 12B:
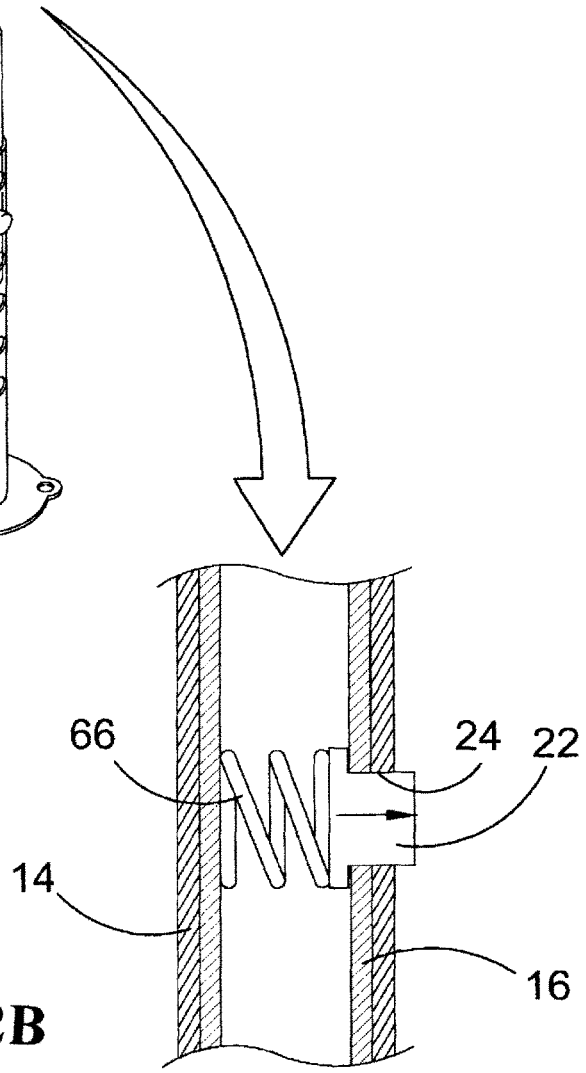

FIG. 12, comprised of FIGS. 12A and 12B in combination, is a detailed view of the present invention.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
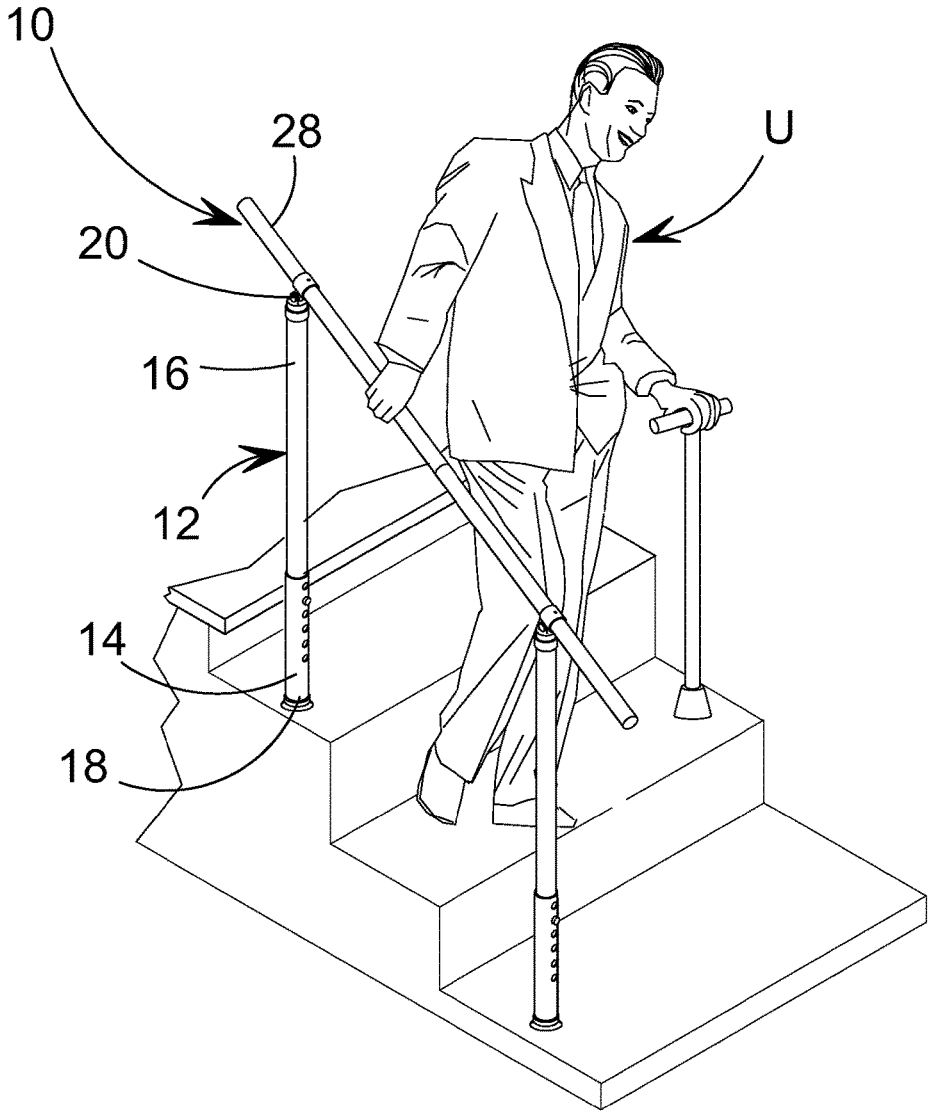

Referring to FIG. 1, shown is an illustrative view of the portable adjustable stair railing indicated at 10. The portable adjustable stair railing 10 comprises a plurality of telescopic balusters 12 having spring fasteners serving as height adjustment latches. These will be discussed further below. Each of the telescopic balusters 12 includes a baluster bottom portion 14 and a baluster top portion 16. The bottom distal end provides structure attachment means 18 taken from the group of adhesive pad, suction cup and/or flange and fasteners as will be detailed hereinafter. The top end of each baluster has a cap and balustrade receptacle or receiving end indicated at 20 for fixedly mounting the telescopic balustrade 28 therein.

Figures 2A, 2B:
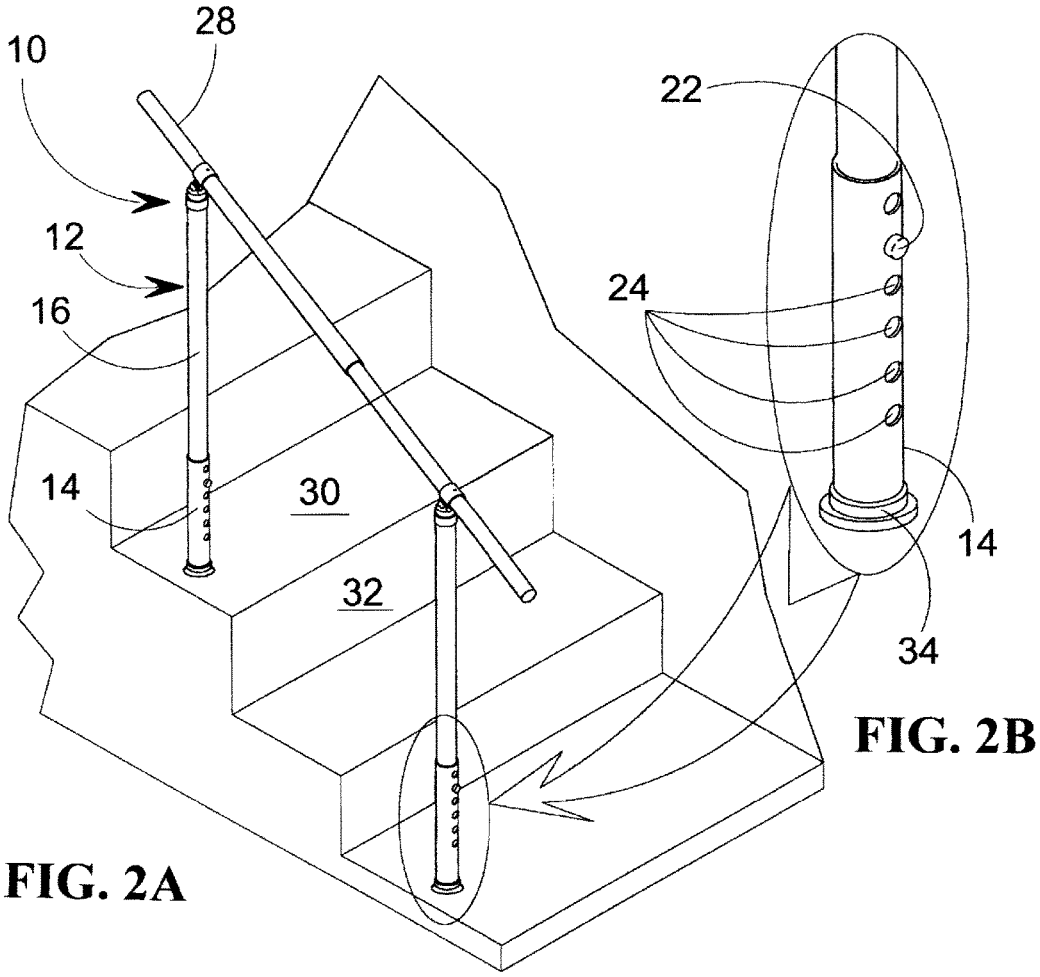

Referring to FIG. 2, which is comprised of FIGS. 2A and 2B in combination, shown is an illustrative view of the portable adjustable stair rail 10 adhesively attached to the stair step 30. In this embodiment the portable adjustable stair rail 10 provides each of the telescoping balusters 12 with a flanged base with an adhesive pad 34 for securing the balusters to the structure (in the illustrated case the stair steps 30 and their associated risers 32). Each baluster 12 comprises telescopic members 14, 16 having a biased spring latch or button 22 located on top portion 16, the biased engagement 22 being seatable within one of a plurality of baluster apertures 24 located on bottom portion 14. This allows for necessary height adjustments during installation.

Figures 3A, 3B:
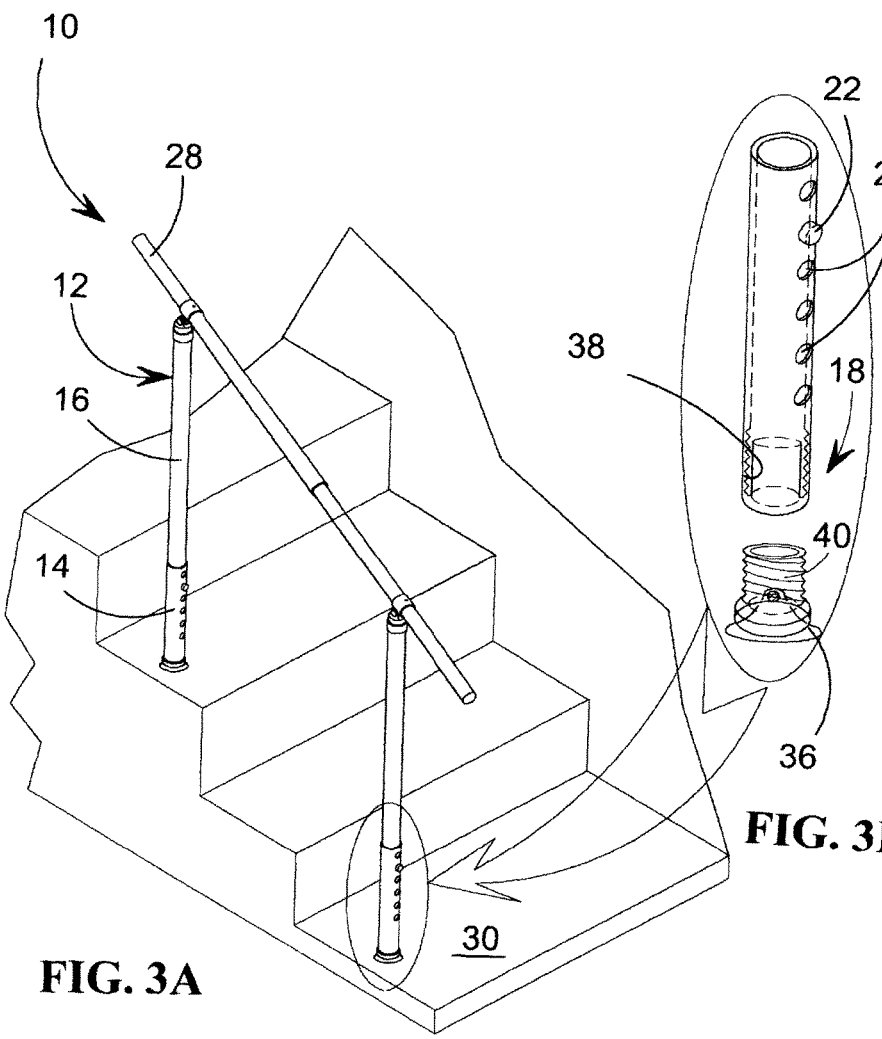

Referring now to FIG. 3, which is comprised of FIGS. 3A and 3B in combination, shown is an illustrative view of another embodiment of the portable adjustable stair rail 10 with a suction cup attachment means. In this embodiment, the portable adjustable rail 10 provides balusters 12 having a suction cup 36 on the bottom portion structure attachment end 18 that threadedly attaches within a respective baluster as indicated at 38 and 40. This secures each baluster 12 to structure (stair step 30). Each baluster 12 is telescopically extendable having a spring latch 22 seatable within one of a plurality of baluster apertures 24.

Figures 4A, 4B:
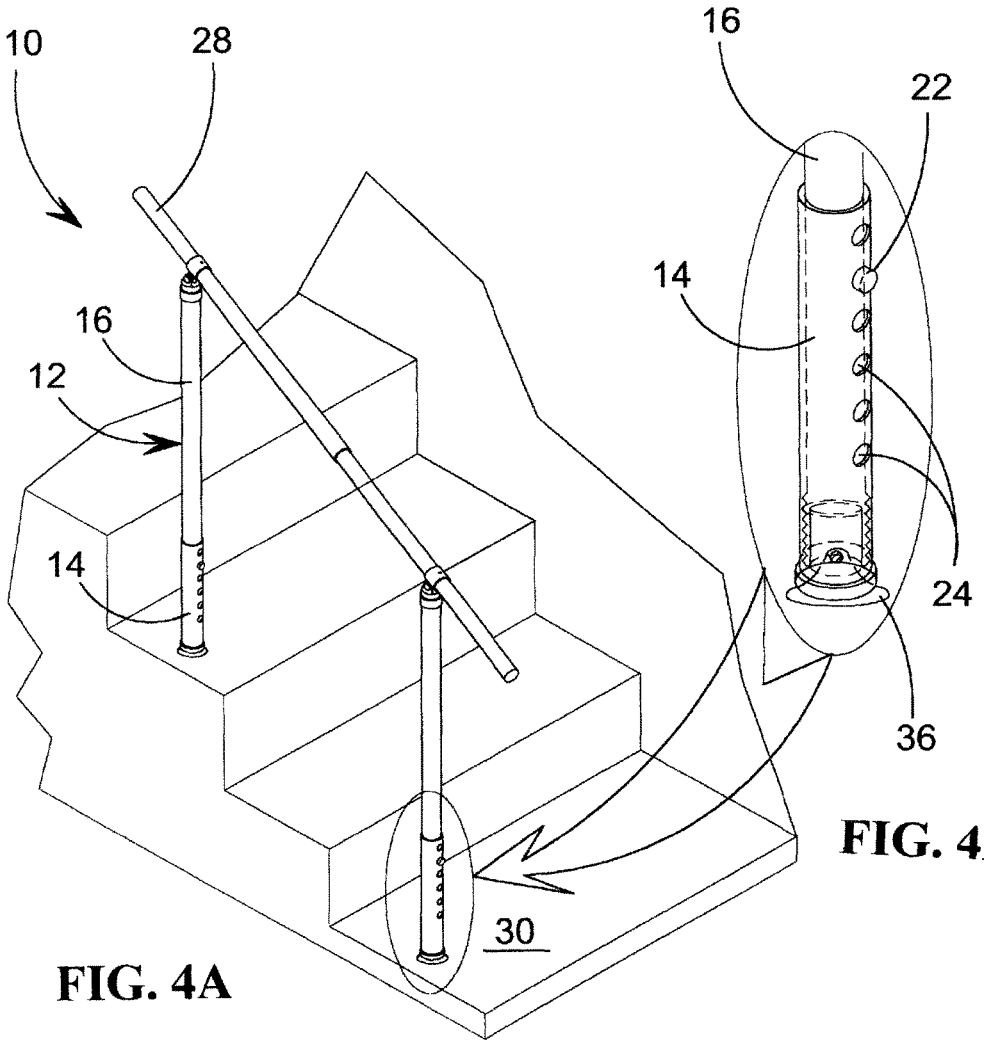

Referring to FIG. 4, which is comprised of FIGS. 4A and 4B in combination, shown is an illustrative view of the portable adjustable stair rail 10 with attached suction cup 36. This embodiment of the portable adjustable rail 10 also provides balusters 12 having a suction cup 36 that threadedly attaches within the respective baluster 12 (as clearly shown in FIG. 3) thereby securing each baluster to the stair step 30. Each baluster 12 is telescopically extendable having a spring latch (indicated at 22) seatable within one of a plurality of baluster apertures 24.

Figure 5:
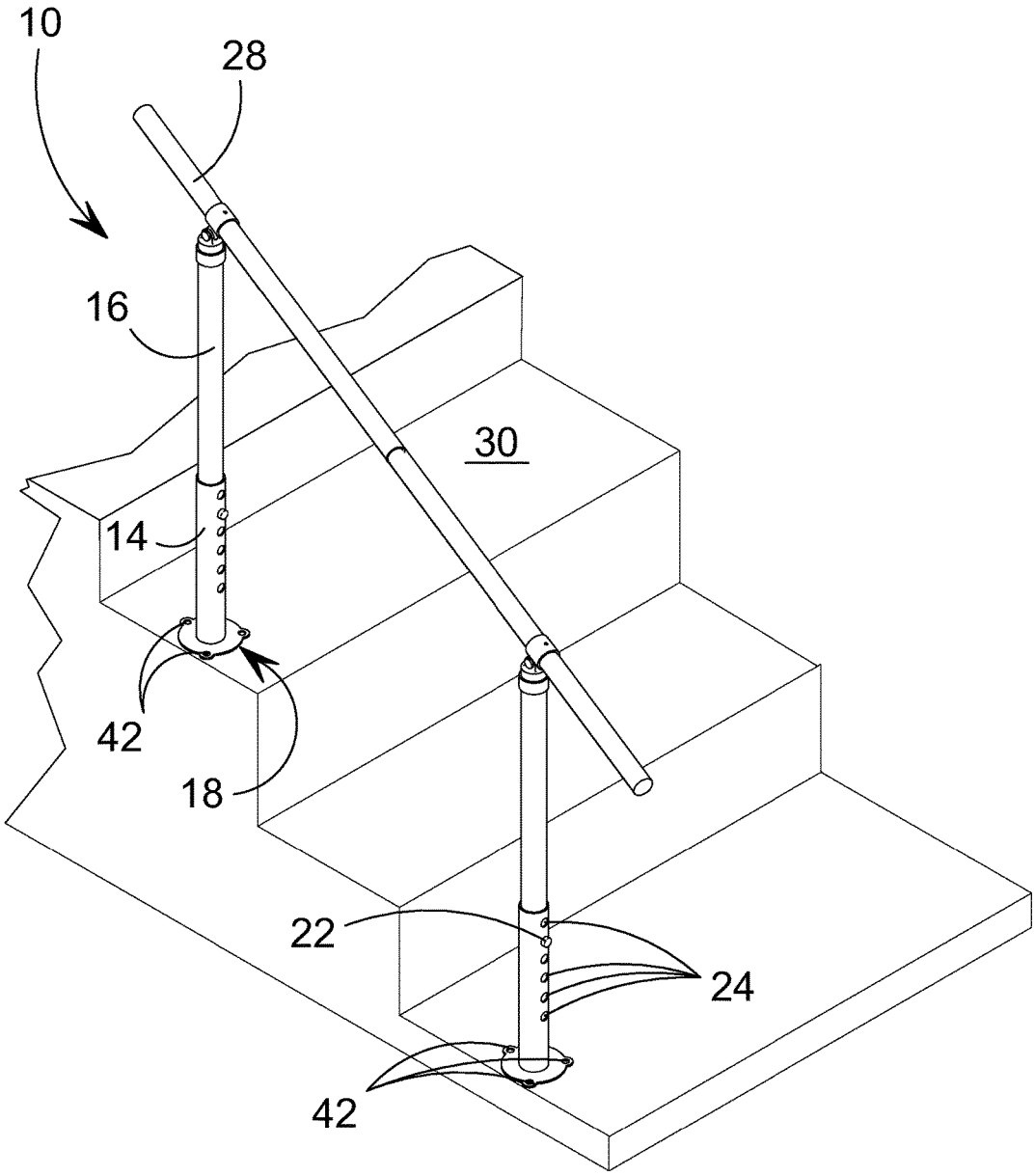
FIG. 5 is an illustrative view of the portable adjustable stair rail.

Referring to FIG. 5, shown is another embodiment of the portable adjustable stair rail 10. The portable adjustable stair railing 10 provides means for easily mounting a railing (balustrade) to stairs not equipped therewith so that someone who has been recently injured or handicapped is provided with support while moving up or down stairs. Shown is a portable stair railing 10 secured to a structure, such as concrete by removable fasteners 42. These removable fasteners 42 could be concrete screws, wood screws, bolts of various kinds, or any type of secure fastening means that would hold the baluster 12 in place while in use.

Figure 6:
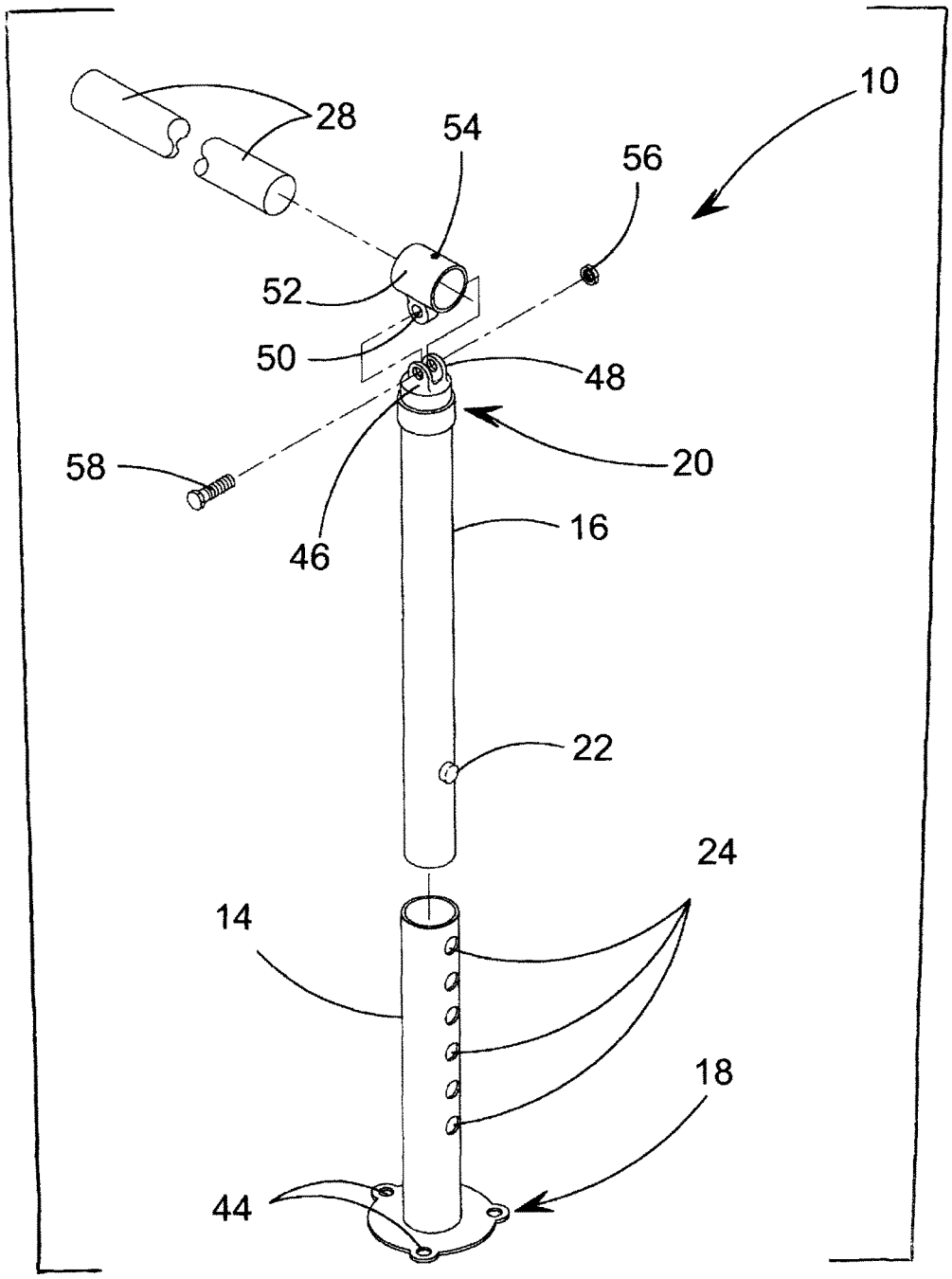
FIG. 6 is an exploded view of the present invention.

Referring to FIG. 6, shown is an exploded view of the present invention. This is the same embodiment as seen in FIG. 5 with the removable fasteners 42 attaching the portable stair railing 10 to a structure. The baluster bottom portion structure attachment end 18 is seen in the Figure to be flanged and has a plurality of fastener receiving apertures 44. This end 18 is attached to baluster bottom portion 14 and the top portion 16 culminates in the balustrade receiving end 20. Both portions 14, 16 fit together in a sleeve-type arrangement. The receiving end 20 of the top portion 16 includes a pivot assembly with receivers 46 and 48 extending upwardly from the balustrade receiving end 20 and the balustrade pivot extender portion 50 depending from the pivoting balustrade receiver 52. This balustrade receiver is dimensioned to snugly fit the telescoping balustrade 28 which then may be secured by the balustrade set screw indicated at 54. The whole cooperating pivot assembly rotates on a pivot bolt 58 and a pivot nut 56.

Figure 7:
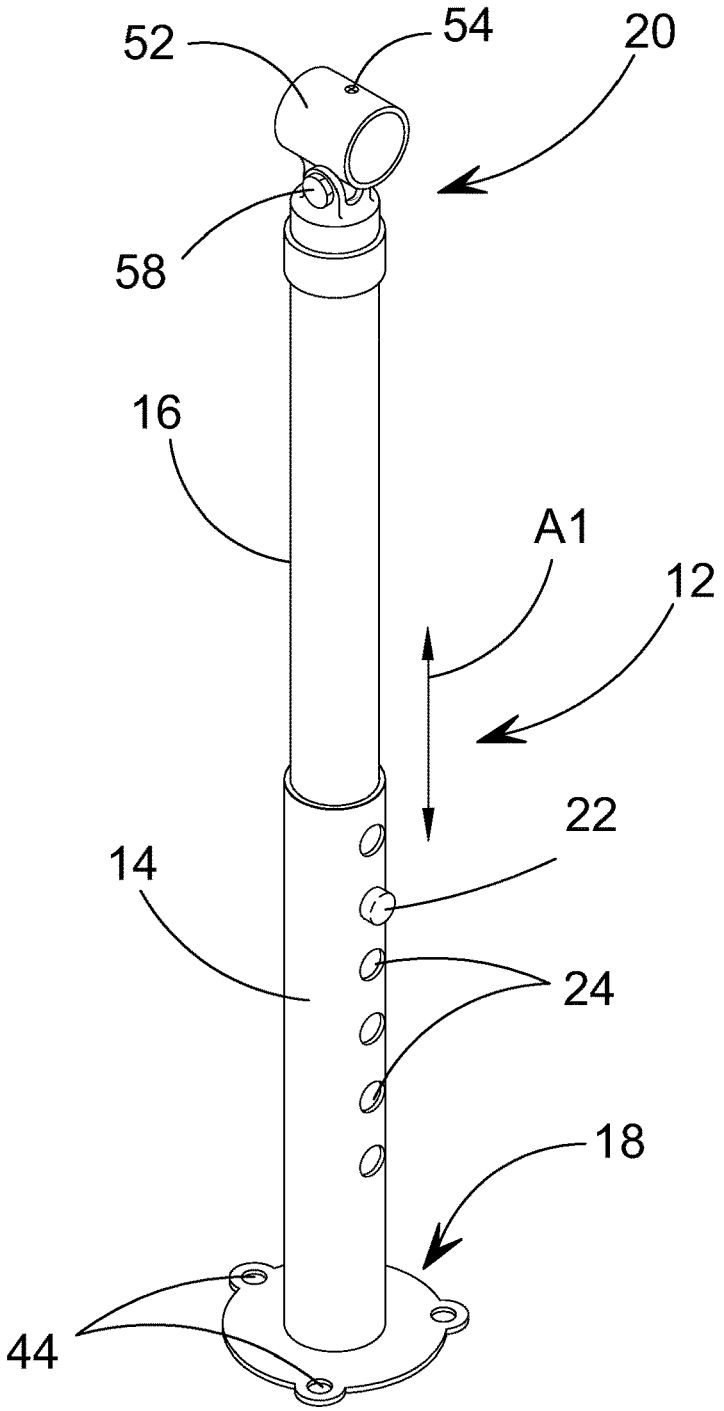
FIG. 7 is an assembled view of a baluster of the portable adjustable stair railing.

Referring to FIG. 7, shown is an assembled view of a single telescoping baluster 12 of the portable adjustable stair railing 10. In this Figure the baluster has a flanged base for the structural attachment end 18 with fastener apertures 44 for securing the baluster to the structure. The balusters 12 are telescopic with one bottom portion 14 having a plurality of spaced apart apertures indicated at 24 and the other top portion having an irrepressible spring latch 22 engage able with a corresponding desired baluster aperture 24. The baluster bottom portion 14 and bottom portion 16 are slidably interfitted and the resulting height may be set as indicated by directional arrow A1.

Figure 8:
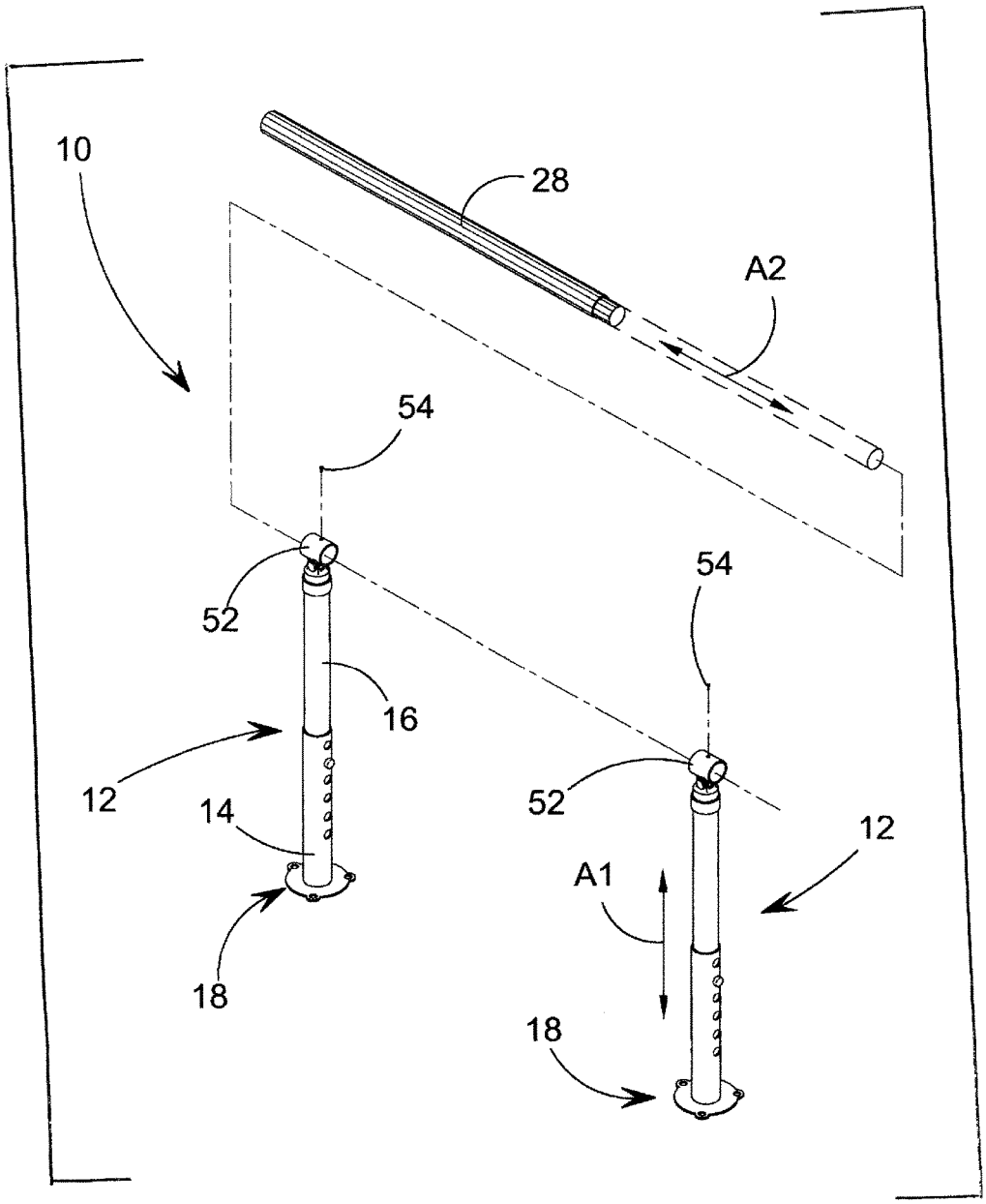
FIG. 8 is a perspective view of the portable adjustable stair railing.

Referring to FIG. 8, shown is a perspective view of the portable adjustable stair railing 10 with both the telescopic balustrades 12 (two are seen in the Figure: it should be noted that more than two would be necessary for longer staircases and the resulting length of the balustrade required) in a collapsed configuration. The balustrade 28 is extended as indicated by directional arrow A2 then inserted into the pivoting baluster collar or receiver where then the balustrade pitch is fixed through tightening of the pivot bolt 58 and nut 56 (seen in FIG. 6) and fixedly secured within the collar by means of the set screw 54.

Figure 9:
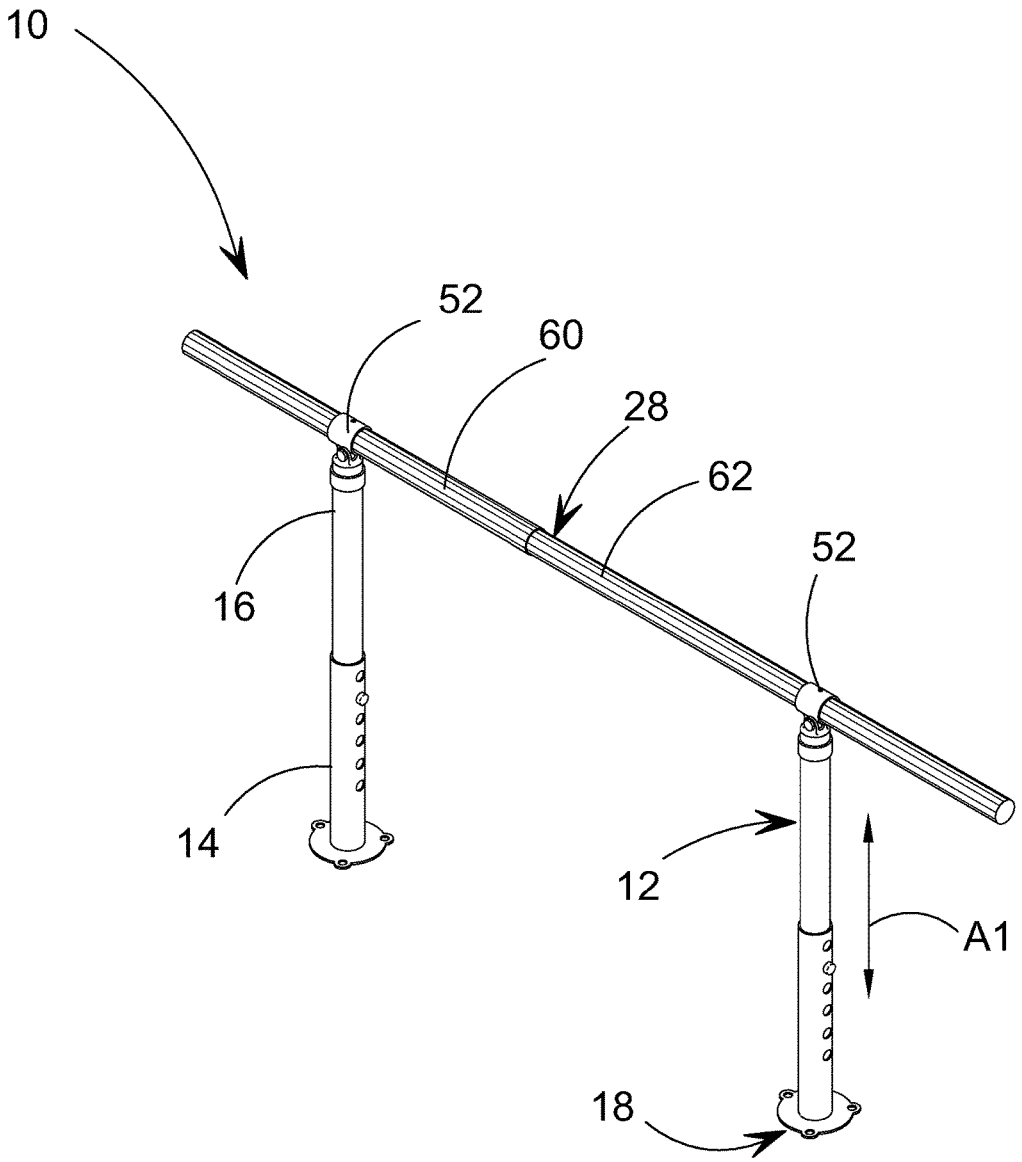
FIG. 9 is a perspective view of the portable adjustable stair railing.

Referring to FIG. 9, shown is a perspective view of the portable adjustable stair railing 10 assembled with two of the telescopic balusters 12 in place. As can be seen in the Figure, telescopic balustrade 28 consists of a first and a second telescopic balustrade section indicated at 60 and 62 slidably interengaged one within the other. It should be noted that more than two balustrade sections could be used if necessary. The balustrade sections are fitted through the collar or receiver 52 once the collars are set at the correct angle or pitch and fixed by tightening the pivot bolt and nut 58, 56 as seen in FIG. 6. The balustrade 28 is then secured by means of the set screws 54 (as seen in FIG. 8).

Referring to FIG. 10, which is comprised of FIGS. 10A and 10B in combination, shown is an exploded detail view of the pivoting feature located on the baluster top portion receiving end 20. As mentioned previously, the balustrade pivot extender 50 depends from the pivoting balustrade receiver 52 and fits into the pivot receivers 46 and 48 such that the pivot apertures 64 are aligned and then may receive the pivot bolt 58. When the balustrade 28 is inserted and is at the correct pitch, the pivot nut 56 may be tightened to hold the balustrade at the correct angle after which the balustrade set screw 54 secures it in place.

Referring to FIG. 11, which is comprised of FIGS. 11A and 11B in combination, shown is a detailed view of the present invention, specifically the locking mechanism that adjusts the height of the telescopic balusters 12. In the embodiments described herein, the top portion 16 of the telescopic baluster includes the biased engagement means 22, in this case a spring loaded button or the like that is configured to fit into one of the corresponding apertures 24 located on the bottom portion 14 of the telescopic baluster 12. As can be seen in the Figure, the user may simply depress the button 22 compressing the spring 66 and slide the two portions 14, 16 sleeve-wise one within the other until the desired height is obtained and then the engagement means will pop out and fit into one of the apertures 24 as seen in FIG. 12 to lock into place.

Shown is a detailed view of the extendable retractable sleeve incorporating spring seatable fastener having spring compressed and within the receiving base portion of the device. The fastener is shown in a retracted position prior to popping through one of a plurality of receiving apertures to lock it in place.

Referring to FIG. 12, which is comprised of FIGS. 12A and 12B in combination, shown is a detailed view of the present invention with the spring loaded engagement means 22 locked into the aperture 24. As mentioned above, in the embodiment described herein the engagement means 22 is located on the top portion 16 of the telescoping balustrade and the receiving apertures with which it cooperates are located on the lower or bottom portion 14.

When a user U (seen in FIG. 1) is incapacitated, handicapped, or otherwise rendered less able, it can be hazardous to have them walk up and down staircases that don't have handrails. In many cases, their ability to negotiate these will return after therapy or recuperation time. This makes it unnecessary to make permanent alterations in the structure of either their homes or their workplace. Thus the present invention allows for a temporary "fix" that provides stability and protection while the user goes up and down the steps.

With the structural attachment means for the baluster being adhesive, suction cups (this would work particularly well on smooth polished wood where adhesives or intrusive attachment means could mar the valuable finish), or the removable attachment means (screws and the like) themselves the installation is temporary and may be easily removed after it is no longer needed. Additionally, the varying pitch feature and modularity of the present invention allows for the device to be placed on staircases with varying pitch lines and runs.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What I claim is:

1. A portable adjustable railing in combination with stairs of a staircase, comprising:

a staircase with a plurality of stairs with stairs of said plurality of stairs located at different distances above a floor;

at least two telescopic balusters positioned on said plurality of stairs located at different distances above the floor, each of said telescopic balusters including a bottom portion, a top portion, and spring-biased engagement means to fix said top portion and said bottom portion in a colinear position at a predetermined height; and where said bottom portion further includes a structural attachment means for fixing said bottom portion in a predetermined position on or within a structure, and further where said top portion includes a balustrade engagement means; a telescopic balustrade including at least two balustrade sections slidably and colinearly engaged with one another; wherein the telescopic balustrade is continuous and entirely tubular; wherein each balustrade section has a different diameter than each adjacent balustrade section, such that each balustrade section is slidably engaged with each adjacent balustrade section; wherein a first portion of the telescoping balustrade extends in opposite directions from a first baluster; wherein a second portion of the telescoping balustrade extends in opposite directions from a second baluster, said telescopic balustrade adapted to be received within said balustrade engagement means on said top portion of said telescopic baluster; whereby said bottom portion of each of said telescopic balusters is attached to a structure in a predetermined position, the height of each of said telescopic balusters is set, and said telescopic balustrade is extended and attached through said balustrade engagement means to provide temporary support to a user.

2. The portable adjustable railing in combination with stairs of a staircase according to claim 1, wherein said structural attachment means is a suction cup.

3. The portable adjustable railing in combination with stairs of a staircase according to claim 2, wherein said suction cup is mounted within a mounting ring and said suction cup mounting ring and said telescopic baluster bottom portion are threadably attached to one another.

4. The portable adjustable railing in combination with stairs of a staircase according to claim 3, wherein said balustrade engagement means comprises a collar dimensioned to receive said telescopic balustrade.

5. The portable adjustable railing in combination with stairs of a staircase according to claim 4, wherein said balustrade engagement means collar is mounted on a pivot such that the pitch of said balustrade engagement means collar may be adjusted to a desired angle prior to receiving said telescopic balustrade.

6. The portable adjustable railing in combination with stairs of a staircase according to claim 1, wherein said structural attachment means is an adhesive pad.

7. The portable adjustable railing in combination with stairs of a staircase according to claim 6, wherein said balustrade engagement means comprises a collar dimensioned to receive said telescopic balustrade.

8. The portable adjustable railing in combination with stairs of a staircase according to claim 7, wherein said balustrade engagement means collar is mounted on a pivot such that the pitch of said balustrade engagement means collar may be adjusted to a desired angle prior to receiving said telescopic balustrade.

9. The portable adjustable railing in combination with stairs of a staircase according to claim 1, wherein said structural attachment means comprises a flange including a plurality of apertures adapted to receive removable fasteners.

10. The portable adjustable railing in combination with stairs of a staircase according to claim 9, wherein said balustrade engagement means comprises a collar dimensioned to receive said telescopic balustrade.

11. A portable adjustable railing in combination with stairs of a staircase, comprising:

a staircase with a plurality of stairs with stairs of said plurality of stairs located at different distances above a floor;

at least two telescopic balusters positioned on said plurality of stairs located at different distances above the floor, each of said telescopic balusters including a bottom portion, a top portion, and spring-biased engagement means to fix said top portion and said bottom portion in a colinear position at a predetermined height; and where said bottom portion further includes a structural attachment means for fixing said bottom portion in a predetermined position on or within a structure, and further where said top portion includes a balustrade engagement means; a telescopic balustrade including at least two balustrade sections slidably and colinearly engaged with one another, wherein the telescopic balustrade is continuous and entirely tubular: wherein each balustrade section has a different diameter than each adjacent balustrade section, such that each balustrade section is slidably engaged with each adjacent balustrade section; wherein a first portion of the telescoping balustrade extends in opposite directions from a first baluster; wherein a second portion of the telescoping balustrade extends in opposite directions from a second baluster, said telescopic balustrade adapted to be received within said balustrade engagement means on said top portion of said telescopic baluster; and where said balustrade engagement means comprises a collar dimensioned to receive said telescopic balustrade; whereby said bottom portion of each of said telescopic balusters is attached to a structure in a predetermined position, the height of each of said telescopic balusters is set, and said telescopic balustrade is extended and attached through said balustrade engagement means collar to provide temporary support to a user.

12. The portable adjustable railing in combination with stairs of a staircase according to claim 11, wherein said balustrade engagement means collar is mounted on a pivot such that the pitch of said balustrade engagement means collar may be adjusted to a desired angle prior to receiving said telescopic balustrade.

13. The portable adjustable railing in combination with stairs of a staircase according to claim 12, wherein said colinear engagement means between said telescopic baluster top portion and said telescopic baluster bottom portion comprises a biased engagement surface and cooperating apertures.

14. The portable adjustable railing in combination with stairs of a staircase according to claim 13, wherein said balustrade engagement means collar includes a set screw to fix said telescopic balustrade in a desired position.

15. The portable adjustable railing in combination with stairs of a staircase according to claim 14, wherein said structural attachment means is an adhesive pad.

16. The portable adjustable railing in combination with stairs of a staircase according to claim 14, wherein said structural attachment means comprises a flange including a plurality of apertures adapted to receive removable fasteners.

17. The portable adjustable railing in combination with stairs of a staircase according to claim 14, wherein said structural attachment means is a suction cup.

18. The portable adjustable railing in combination with stairs of a staircase according to claim 17, wherein said suction cup is mounted within a mounting ring and said suction cup mounting ring and said telescopic baluster bottom portion are threadably attached to one another.

19. A portable adjustable railing in combination with stairs of a staircase, comprising:

a staircase with a plurality of stairs with stairs of said plurality of stairs located at different distances above a floor;

at least two telescopic balusters positioned on said plurality of stairs located at different distances above the floor, each of said telescopic balusters including a bottom portion, a top portion, and spring-biased engagement means to fix said top portion and said bottom portion in a colinear position at a predetermined height; and where said bottom portion further includes a structural attachment means for fixing said bottom portion in a predetermined position on or within a structure, and further where said top portion includes one collar from a plurality of collars selected for engaging a balustrade, wherein each collar is mounted on a pivot such that the pitch of the collar may be adjusted to a desired angle prior to receiving the continuous telescopic balustrade;

a telescopic balustrade including at least two balustrade sections slidably and colinearly engaged with one another; wherein the telescopic balustrade is continuous and entirely tubular; wherein each balustrade section has a different diameter than each adjacent balustrade section, such that each balustrade section is slidably engaged with each adjacent balustrade section; wherein each balustrade section passes through one of the collars affixed to one of the at least two telescopic balusters; wherein a first portion of the telescoping balustrade extends in opposite directions from a first baluster; wherein a second portion of the telescoping balustrade extends in opposite directions from a second baluster; wherein each balustrade section is mechanically attached to one of the collars, said telescopic balustrade adapted to be received within said plurality of collars on said top portion of said telescopic baluster; whereby said bottom portion of each of said telescopic balusters is attached to a structure in a predetermined position, the height of each of said telescopic balusters is set, and said telescopic balustrade is extended and attached through said balustrade engagement means to provide temporary support to a user.

* * * * *